United States Patent [19]

Yoshino

[11] 3,978,651

[45] Sept. 7, 1976

[54] STEP MOTOR FOR QUARTZ CRYSTAL ELECTRONIC TIMEPIECE

[75] Inventor: Masahito Yoshino, Suwa, Japan

[73] Assignee: Kabushiki Kaisha Suwa Seikosha, Tokyo, Japan

[22] Filed: Dec. 27, 1974

[21] Appl. No.: 537,029

[52] U.S. Cl. ..... 58/23 D; 310/40 MM

[51] Int. Cl.[2] ..... G04C 3/00

[58] Field of Search ..... 58/23 R, 23 D; 310/36–39, 49 R, 254, 42, 40 MM; 318/130; 29/205 R

[56] References Cited

UNITED STATES PATENTS

| | | | |
|---|---|---|---|
| 2,589,959 | 3/1952 | Quick | 310/39 |
| 2,798,171 | 7/1957 | Craddock | 310/39 X |
| 2,909,685 | 10/1959 | Szabo | 310/42 X |
| 3,390,289 | 6/1968 | Dijken et al. | 310/254 X |
| 3,541,778 | 11/1970 | Ingenito et al. | 58/23 R |
| 3,737,746 | 6/1973 | Cielaszyk et al. | 310/37 X |
| 3,810,354 | 5/1974 | Naikaido et al. | 58/23 D |

*Primary Examiner*—Ulysses Weldon

*Attorney, Agent, or Firm*—Blum, Moscovitz, Friedman & Kaplan

[57] ABSTRACT

A step motor particularly suited for use in a quartz crystal electronic timepiece and adapted to minimize adjustment and fixing of the step motor is provided. The step motor includes a coil adapted to receive a timekeeping signal of a predetermined frequency. A low permeable reference member having two high permeable stator yokes integrally mounted thereto is provided, said yokes being electrically coupled to said coil to be magnetized thereby in a first and second magnetic orientation in response to the application of the timekeeping signal to the coil. A permanent magnet rotor is surrounded by the stator yokes, the rotor being stepped in response to each change in the magnetic orientation of the stator yokes.

5 Claims, 4 Drawing Figures

STEP MOTOR FOR QUARTZ CRYSTAL ELECTRONIC TIMEPIECE

BACKGROUND OF THE INVENTION

This invention is directed to a step motor for a quartz crystal electronic timepiece, and in particular to an improved stator assembly for a step motor particularly adapted for use in an electronic wristwatch. Although step motor arrangements in electronic timepieces have taken on various forms, the necessity of adjusting the position of the stator yokes with respect to each other and the rotor requires considerable time during either assembly or post-sales service. Further, the adjustment of the stator during post-sales service requires easy access to the stator yokes in order to facilitate adjustment thereof. Moreover, the bridge supporting the rotor, and other elements of the step motor must be maintained visible in order to allow the person making the adjustment to view the relative positions of the stator yokes and the rotor in order to effect the necessary adjustments. The foregoing places serious limitations on the orientation of the components within the timepiece and the size thereof. Accordingly, such prior art stator assemblies requiring adjustments have been less than completely satisfactory.

SUMMARY OF THE INVENTION

Generally speaking, a step motor particularly suited for use in a quartz crystal electronic timepiece is provided. The step motor includes a coil adapted to receive a timekeeping signal of a predetermined frequency. A low permeable reference member includes at least two high permeable stator yokes integrally mounted thereto, the stator yokes being electrically coupled to said coil to thereby be magnetized in a first and second magnetic orientations in response to the application of the timekeeping signal to said coil. A permanent magnet rotor is surrounded by the stator yokes, the rotor being stepped in response to each change in magnetic orientation of the stator yokes.

Accordingly, it is an object of this invention to eliminate the necessity of in situ adjustments of step motors in an electronic timepiece.

Still another object of this invention is to eliminate the necessity of post-sales and assembly adjustments of the stator assembly in an electronic timepiece.

Still another object of this invention is to provide an improved step motor having a stator assembly wherein the positioning of the stator with respect to the other operative elements of the step motor is not affected by shocks and the like.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

DETAILED DESCRIPTION OF THE PREFERRED EMBODIMENTS

Figure 1:
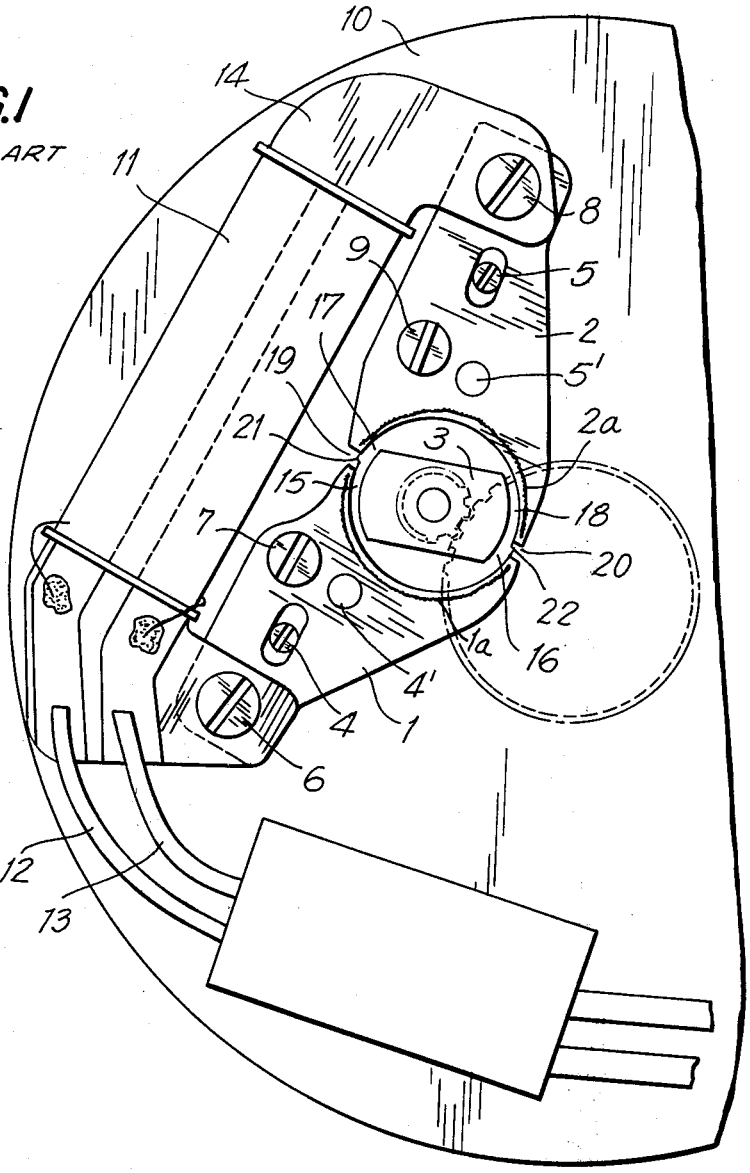
FIG.1 PRIOR ART
FIG. 1 is a plan view of an electronic timepiece including a step motor constructed in accordance with the prior art.

Reference is now made to FIG. 1 wherein an electronic timepiece including a step motor constructed in accordance with the prior art is depicted. The step motor includes stator yokes 1 and 2 surrounding a rotor 3. The position of the stator yokes 1 and 2 are respectively adjusted by rotating stator yoke 1 about pin 4' by the movement of eccentric pin 4 and the rotation of stator yoke 2 about pin 5' by the movement of eccentric pin 5. The stator yokes are mounted to the watch plate 10 by means of screws 6, 7, 8 and 9 after the relative position of the stator yokes has been adjusted.

The mounting of the stator yokes to the watch plate 10 by screws 6 and 8 further couples the stator yokes to a coil core 14 which produces magnetic flux in response to the application of a timekeeping pulse to coil 11. Coil 11 is coupled to conventional electronic timepiece circuitry by leads 12 and 13, said circuitry being adapted to produce a timekeeping signal of a predetermined frequency to thereby alternately energize the coil to produce an alternating magnetic flux field in the yokes. The yokes 1 and 2 provide a path for the flux to rotor 3 positioned in the gap between the yokes, the magnetic orientation of the stator yokes 1 and 2 being alternately varied by the alternating magnetic flux. Rotor 3 is formed with one or more permanent magnets having circumferentially spaced poles and is rotated in response to the attraction and repulsion between the poles thereof and the magnetic polarity generated along the edge surfaces 1a and 2a of the respective stator yokes. In order to maintain the accuracy of the timepiece, it is necessary that the rotor 3 be rotated through a specific angle in response to each pulse applied to coil 11. Accordingly, the precise stepping of the rotor through a specific predetermined angle for each pulse applied thereto is based on the complex relationship between the magnetomotive force of the coil 11, the strength of the magnetic field in the opposite magnetic poles of the rotor 3, the gap between the rotor and the stator yoke 1, indicated as 15 and 16, the gap between the rotor and stator yoke 2, indicated as 17 and 18, the gaps between the two stator yokes, indicated as 19 and 20, as well as the lateral offsets, indicated as 21 and 20, between the end portions of the stator yokes defining gap therebetween.

Accordingly, during the assembly of an electronic timepiece utilizing such a conventional step motor, it is necessary to adjust positions of the stators 1 and 2 by means of eccentric pins 4 and 5. Once the rotor is mounted in a timepiece, the gaps indicated as 15 through 22 must be precisely maintained to insure that the rotor provides an output representative of actual time in response to the timekeeping pulses applied to coil 11. Positioning of the yokes is achieved by visual positioning relative to each other and the rotor and by consideration of the waveform in coil 11 when a driving signal is applied thereto. In order to permit adjustment of the stator yokes once the stator yokes have been mounted, nothing, including the bridge supporting of the rotor, can obstruct the view of the various gaps. Also, in the event that stator yokes must be adjusted after the rotor assembly is mounted, special tools must be utilized to achieve such adjustments. Accordingly, not only does such adjustment take considerable time and cause an increase in the size of the timepiece, it is disadvantageous in view of the post-sales service required thereby. Accordingly, a stator assembly which is not misaligned and does not require adjustment upon receiving shocks and the like is desired.

Figure 2:
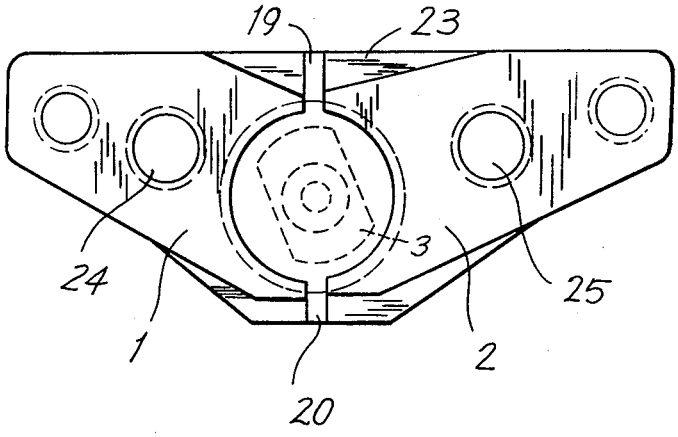
FIG. 2 is a plan view of a stator assembly constructed in accordance with the instant invention.
Figure 3:
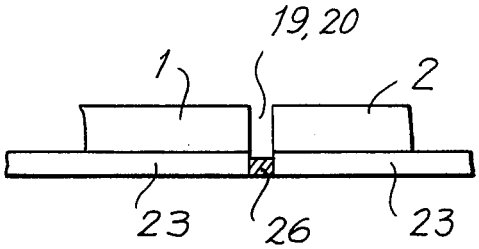
FIG. 3 is a partial elevated view of the stator assembly illustrated in FIG. 2.

Reference is now made to FIGS. 2 and 3 wherein a stator assembly constructed in accordance with the instant invention is depicted, like reference numerals being utilized to denote like elements. Accordingly two stator yokes 1 and 2 are mounted to a non-magnetic stator pedestal 23 by welding or other like mounting processes to thereby define an integral stator assembly. The stator yokes may, originally, be a single element. Thereafter, portions are removed from the single element to thereby define gaps 19 and 20 between stator yokes 1 and 2. As is particularly illustrated in FIG. 3, the cut gaps 19 and 20 divide the stators 1 and 2 and enable same to be magnetically isolated from each other. Moreover, the stator yokes 1 and 2 and the stator pedestal 23 are formed as a single component part and can therefore be mounted to a watch plate by guide openings 24 and 25 in the same manner that a bridge is mounted to a watch plate. Moreover, because the stator plates are fixedly mounted to the pedestal plate and therefore cannot be moved with respect thereto or with respect to each other, the gap tolerances 15 through 18 between stator yokes 1 and 2 and the rotor 3, as well as the gaps 19 and 20 between stator yoke 1 and stator yoke 2, and the offset alignments 21 and 22 can be permanently maintained thereby allowing the rotor to be stepped in a stable manner through a predetermined angle and further allowing the step motor to be free from requiring further adjustment. It is noted that the unitary stator assembly disclosed herein can be mounted not only to a watch plate but to other frame members in a timepiece. Moreover, although pedestal 23 is preferably formed of a non-magnetic material, it is possible to utilize a higher magnetically permeable material for the pedestal 23 and to utilize a nonpermeable portion 26 in the gap 19 and 20 between the stator yokes or to saturate portion 26 magnetically with flux generated by coil 11.

Figure 4:
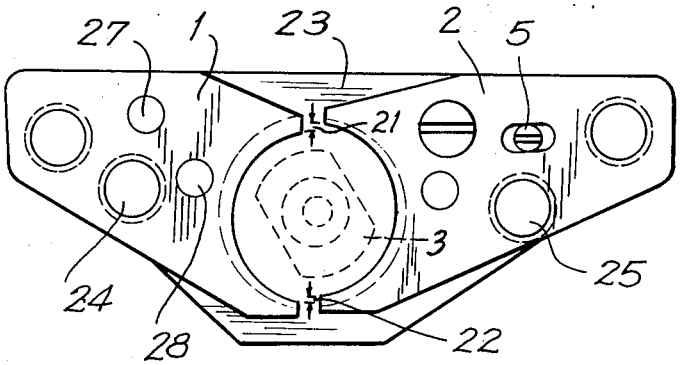
FIG. 4 is a plan view of a stator assembly constructed in accordance with an alternate embodiment of the instant invention.

Reference is now made to FIG. 4 wherein a further embodiment of the instant invention is depicted, like reference numerals being utilized to denote like elements. The stator yoke 1 is fixedly mounted to the non-permeable stator pedestal 23 by guide pins 27 and 28 by conventional welding techniques and the like. The stator yoke 2 is fixed to the stator pedestal 23 after the offset differences 21 and 22 between stator yoke 1 and stator yoke 2 are adjusted within a certain range by utilizing an eccentric find adjusting pin 5. The entire stator assembly including the stator yoke and pedestal are mounted to a plate by utilizing guide openings 24 and 25. Once the stator yokes 1 and 2 are secured to the stator pedestal, the step motor requires no further adjustments. Furthermore, it is noted that such an embodiment allows the stator assembly to be heated as a unitary body without affecting the stator pedestal and accordingly various materials can be utilized for the stator pedestal.

It is noted that the stator yokes 1 and 2 can be formed as a unitary structure by fixedly mounting the stator yokes to the watch plate directly rather than to the stator pedestal. Finally, a step motor which would require no adjustment or post-sales services can also be provided by fixedly mounting, by means of welding, adhering, caulking, wedging or the like, the movable part in an assembly after adjustment is achieved. Although the motor illustrated above in the preferred embodiments of this invention is directed to a rotor stepped in a first rotational direction through a predetermined angle, this invention equally applies to step motors having rotors which are reciprocated through a specific angle in response to the application of a timekeeping signal.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also understood that the following claims are intended to cover all of the generic and specific features of the invention herein described, and all statements of the scope of the invention which, as a matter of language, might be said to fall therebetween.

What is claimed is:

1. In a stepmotor for use in a quartz crystal electronic timepiece, the improvement comprising a reference member; a pair of stator yokes permanently mounted to said reference member and having ends to define the gap therebetween, at least a region of said reference member in registration with said gap being formed of a material of a magnetic permeability less than the permeability of said yokes to substantially magnetically isolate said yokes from each other; said reference member being mountable on a watch plate; and a permanent magnet rotor in said gap surrounded by said stator yokes.

2. A step motor as recited in claim 1, wherein said entire reference member is formed of a material of a magnetic permeability less than the permeability of said yokes.

3. A step motor as recited in claim 2, wherein said stator yokes are formed from a single element, said gap therebetween being formed after said element is permanently secured to said reference member.

4. A step motor as recited in claim 2, wherein said timepiece includes a plate for supporting the elements thereof, said reference member bearing said yokes being releasably mounted as a unit on said plate.

5. A step motor particularly suited for use in a quartz crystal electronic timepiece comprising a reference member; a pair of stator yokes permanently mounted to said reference member and having ends to define a gap therebetween, said reference member being formed of a magnetic material, the region of said reference member in registration with said gap being magnetically saturated to substantially mganetically isolate said yokes from each other except through said gap; and a permanent magnet rotor in said gap surrounded by said stator yokes, the rotor being rotated in response to changes in the magnetic orientation of said stator yokes.

* * * * *